US008163456B2

(12) United States Patent
Hayata et al.

(10) Patent No.: US 8,163,456 B2
(45) Date of Patent: Apr. 24, 2012

(54) IMAGE FORMING METHOD AND IMAGE FORMING APPARATUS

(75) Inventors: Hirofumi Hayata, Tokyo (JP); Masahiko Kurachi, Tokyo (JP); Toshiyuki Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 542 days.

(21) Appl. No.: 12/410,528

(22) Filed: Mar. 25, 2009

(65) Prior Publication Data

US 2009/0258312 A1 Oct. 15, 2009

(30) Foreign Application Priority Data

Apr. 11, 2008 (JP) ..... 2008103430

(51) Int. Cl.
*G03G 13/08* (2006.01)

(52) U.S. Cl. ..... 430/123.4; 430/123.41; 430/123.42; 430/123.51; 430/125.3

(58) Field of Classification Search ..... 430/123.4, 430/123.41, 123.42, 123.51, 125.3
See application file for complete search history.

(56) References Cited

U.S. PATENT DOCUMENTS

2005/0037274 A1* 2/2005 Shida et al. ..... 430/60
2005/0214668 A1* 9/2005 Miyakawa et al. ..... 430/108.7

FOREIGN PATENT DOCUMENTS

JP 2000206801 7/2000
JP 2003165857 6/2003
JP 2006259581 9/2006

* cited by examiner

*Primary Examiner* — Hoa V Le
(74) *Attorney, Agent, or Firm* — Lucas & Mercanti, LLP

(57) ABSTRACT

An image forming method and image forming apparatus based on the application thereof wherein comet-like deposits do not appear on the surface of the photoreceptor even after prolonged use of small-diameter toner, and there is no drop-out or damage on the photoreceptor surface in the image forming process using an intermediate transfer member. This image forming method contains a process wherein the toner developed on an electrophotographic photoreceptor is transferred onto an intermediate transfer member, and the toner contains at least a metallic oxide and metallic soap added as external additive agents, and the protective layer contains a resin component obtained by reaction of at least a curable compound, and alumina particles.

12 Claims, 1 Drawing Sheet

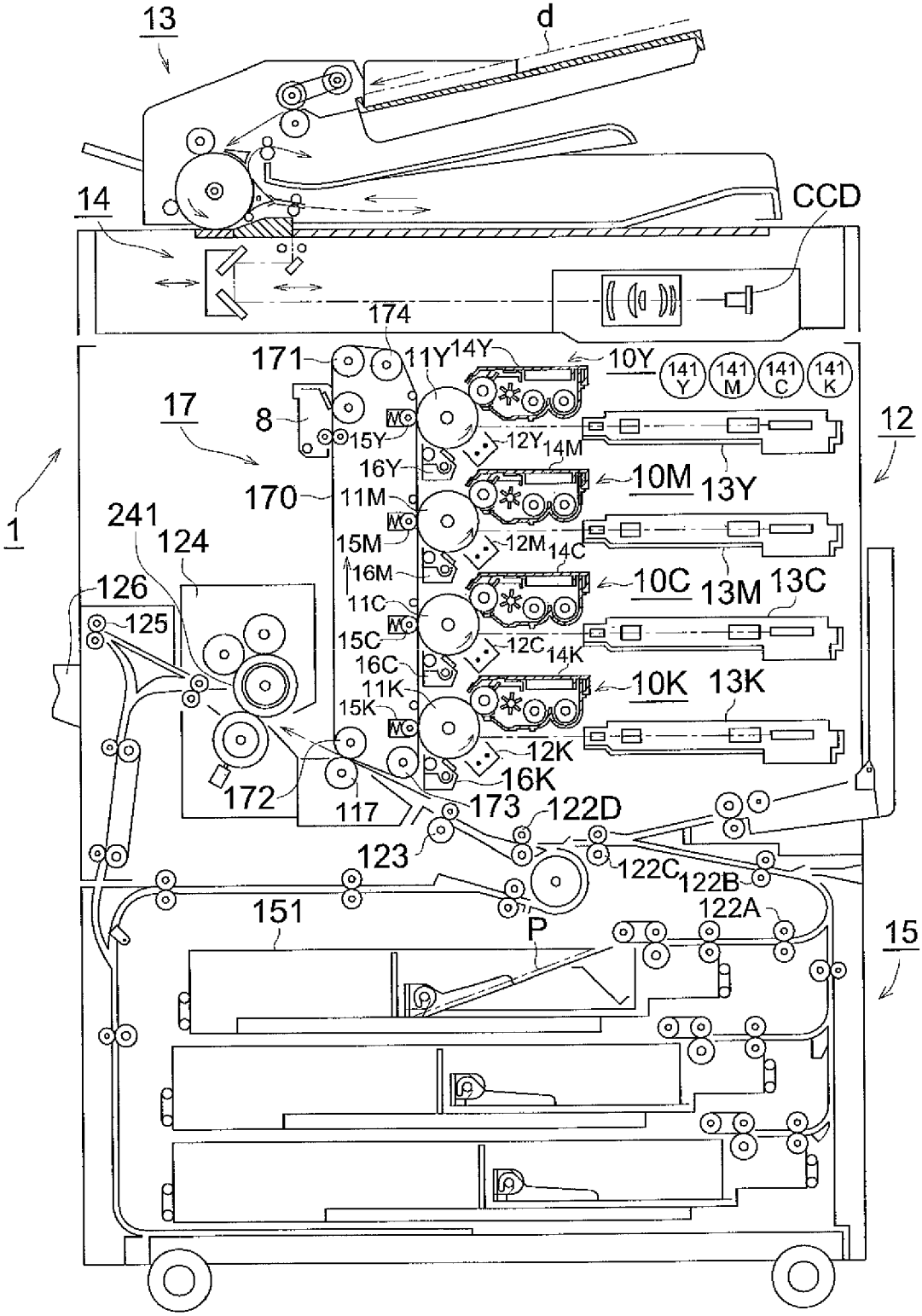
13
d
14
CCD
174
171
11Y
14Y
10Y
141 Y
141 M
141 C
141 K
17
8
15Y
12Y
14M
12
16Y
10M
13Y
170
11M
1
241
124
15M
12M
14C
16M
10C
13M
13C
126
11C
125
15C
12C
14K
16C
10K
13K
11K
15K
12K
16K
172
117
173
122D
123
122C
122B
122A
151
P
15

IMAGE FORMING METHOD AND IMAGE FORMING APPARATUS

This application is based on Japanese Patent Application No. 2008-103430 filed on Apr. 11, 2008 with Japan Patent Office, the entire content of which is hereby incorporated by reference.

BACKGROUND OF THE INVENTION

1. Technical Field

The present invention relates to an image forming method and image forming apparatus using an electrophotographic process.

2. Description of Related Art

In the electrophotographic image forming process, particularly in the electrophotographic color image forming process in recent years, to achieve high-quality color reproducibility by color imposition, there has been widespread use of an image forming process wherein a primary image developed on a photoreceptor is once transferred onto an intermediate transfer member, and is then transferred onto a final printing medium to be fixed thereon (Patent Documents 1 through 3).

To produce a high-resolution image, small-diameter toner of less than 8.0 μm formed by the polymerization method is used as the mainstream toner. The mainstream toner has a greater surface area for its mass and tends to stick to the surface of a photoreceptor and intermediate transfer member. Its transfer efficiency heavily tends to decrease. Thus, there has been widespread use of the method wherein an external additive agent is added to the toner and the toner surface is treated by an external additive agent in order to reduce the adhesion on the toner surface and to improve the transfer efficiency.

In the process of using an intermediate transfer member, treatment of the toner surface by metallic oxide alone is not sufficient to improve transfer efficiency and image quality. Accordingly, metallic soap (aliphatic metallic salt) is directly coated on the surface of the photoreceptor, and metallic soap is contained in the developer, whereby a very thin film of metallic film is formed on the surfaces of the photoreceptor and intermediate transfer member. This arrangement is used to minimize the direct contact between the photoreceptor surface and toner, whereby a desired transfer efficiency and image quality are ensured.

[Patent Document 1] Japanese Unexamined Patent Application Publication No. 2000-206801

[Patent Document 2] Japanese Unexamined Patent Application Publication No. 2006-259581

[Patent Document 3] Japanese Unexamined Patent Application Publication No. 2003-165857

SUMMARY

However, it has been made clear that, if the photoreceptor surface contains both metallic soap (aliphatic metallic salt) as an external additive agent of toner and metallic oxide, comet-like deposits tend to occur on the surface of the photoreceptor due to pressure on the intermediate transfer member. Especially when there is an increase in the number of sheets to be printed, and liberation of external additive agent (metallic oxides) proceeds in the developer, there will be an increase in the size of comet-like deposits which will produce an image defect on the final image.

Since comet-like deposits do not create a serious problem if there is either metallic oxide or metallic soap, this can be said to be a special problem that occurs to the system where both types of these compounds are present.

Generation of comet-like deposits is reduced by the abrasion of the photoreceptor when there is much abrasion. However, as compared with the conventional photoreceptor, abrasion is very small in the case of a photoreceptor provided with a protective layer characterized by excellent abrasion resistance and minimum abrasion of the photoreceptor for the purpose of prolonging the service life of the photoreceptor. Thus, a noticeable number of large-sized comet-like deposits appear.

The present invention has been made to solve the aforementioned problems. The object of the present invention is to provide an image forming method and image forming apparatus based on this image forming method and wherein comet-like deposits do not appear on the surface of the photoreceptor even after prolonged use of the small-diameter toner, and there is no dropout or damage on the photoreceptor surface in the image forming process using an intermediate transfer member.

The present inventors have made concentrated study efforts to minimize the aforementioned comet-like deposits and image defects, and have found out that the problems can be solved by using the following Structures:

1. A method for forming an image comprising steps of:
   (a) developing an electrostatic latent image by a toner on an electrophotographic photoreceptor comprising a conductive support provided thereon, at least a photoreceptive layer and a protective layer in this order; and
   (b) transferring the developed toner to an intermediate transfer member, wherein the toner comprises at least a metal oxide and a metal soap by external addition, and the protective layer comprises at least a resin component by the reaction of a curable compound, and alumina particles.
2. The method for forming an image of item 1, wherein a number of a reactive group in the curable compound is 3 or more.
3. The method for forming an image of item 1, wherein the number of a reactive group in the curable compound is 5 or more.
4. The method for forming an image in any one of items 1-2, wherein an equivalent of a reactive group in the curable compound is 1,000 or less.
5. The method for forming an image in any one of items 1-2, wherein an equivalent of a reactive group in the curable compound is 500 or less.
6. The method for forming an image of item 1, wherein a reactive group in the curable compound is acryloyl group or methacryloyl group.
7. The method for forming an image of item 1, wherein a surface of the alumina particles is hydrophobized by a silane compound.
8. The method for forming an image of item 1, wherein the alumina particles is 1-200 parts by mass with respect to 100 parts by mass of the curable compound.
9. The method for forming an image of item 1, wherein the alumina particles is 10-80 parts by mass with respect to 100 parts by mass of the curable compound.
10. The method for forming an image of item 1, wherein a number average primary particle diameter of the alumina particles is 1-300 nm.
11. The method for forming an image of item 1, wherein a number average primary particle diameter of the alumina particles is 3-100 nm.
12. An image forming apparatus, wherein an image is formed by the method for forming an image of item 1.

The present invention provides an image forming method and image forming apparatus based on the application thereof wherein comet-like deposits do not appear on the surface of the photoreceptor even after prolonged use of small-diameter toner, and there is no dropout or damage on the photoreceptor surface in the image forming process using an intermediate transfer member.

BRIEF DESCRIPTION OF THE DRAWINGS

FIG. 1 is a cross sectional schematic diagram representing an example of the image forming apparatus wherein the intermediate transfer member of the present invention can be employed.

DESCRIPTION OF THE PREFERRED EMBODIMENT

The following describes the details of the present invention:

The image forming method of the present invention contains a process wherein the toner developed an electrophotographic photoreceptor having at least a photosensitive layer and protective layer laminated in that order on the conductive support member is transferred onto an intermediate transfer member. The toner contains at least the metallic oxide and metallic soap added as external additive agents, and the protective layer contains the resin component obtained by the reaction of at least a curable compound, and alumina particles.

It is not clear why comet-like deposits are not produced on the image forming method of the present invention. The present inventors estimate that the protective layer obtained by reaction with the curable compound is different from the conventional protective layer, such as the thermoplastic resin, in the behavior of deformation of the external additive agent of the toner sandwiched between the photoreceptor and intermediate transfer member. Another reason assumed by the present inventors is that the alumina particles present in the vicinity of the photoreceptor surface substantially reduce the adhesion of the photoreceptor surface with respect to the metallic soap or metallic oxide with respect to the developer.

The structure of the present invention contains the protective layer intended to improve the mechanical strength and durability of the electrophotographic photoreceptor (hereinafter referred to as "photoreceptor") and to protect the surface of the photoreceptor. This protective layer includes at least the resin compound obtained by reaction with the curable compound, and alumina particles.

[Photoreceptor Layer Structure]

The photoreceptor of the present invention is made up of at least the photosensitive layer and protective layer provided in that order on the conductive support member. There is no particular restriction to the layer structure. To put it more specifically, this structure is exemplified by the following layers:

1) A structure wherein an electric charge generation layer and electric transport layer as photosensitive layers, and a protective layer are provided in that order on a conductive support member 2) A structure wherein a single layer including an electric transport member and electric charge generation member as photosensitive layers, and a protective layer are provided in that order on a conductive support member 3) A structure wherein an electric charge generation layer and electric transport layer as an intermediate layer and photosensitive layer, and a protective layer are provided in that order on a conductive support member 4) A structure wherein a single layer including an electric transport member and electric charge generation member as an intermediate layer and photosensitive layer, and a protective layer are provided in that order on a conductive support member Any one of the aforementioned structures can be used in the photosensitive layer of the present invention. Of these structures, the one having an intermediate layer, electric charge generation layer, electric charge transport layer, and protective layer formed on the conductive support member is preferably used.

The intermediate layer, electric charge generation layer, electric charge transport layer, and protective layer can be coated according to the dip coating, spray coating, spinner coating, bead coating, blade coating, beam coating, slide hopper coating, and other methods.

[Protective Layer]

The protective layer of the present invention includes at least the resin compound obtained by reaction with the curable compound, as well as alumina particles in the surface layer thereof.

(Curable Compound)

The curable compound preferably used in the present invention includes the monomer as a resin which is formed by polymerization (curing) by actinic irradiation of ultraviolet rays and an electron beam, and which is commonly used as a binder of the photoreceptor, such as polystyrene and polyacrylate. Particularly preferred examples include styrene monomer, acrylic monomer, methacrylic monomer, vinyl toluene monomer, vinyl acetate monomer, and N-vinyl pyrrolidone monomer.

Of these, a particularly preferred example is the photocurable acrylic compound including an acryloyl group or methacryloyl group, because this compound can be cured by a small amount of light or in a shorter period of time.

In the present invention, these monomers can be used independently or in a mixed form.

The following shows examples of the photocurable acrylic compound (hereinafter referred to as (acrylic compound):

The acrylic compound of the present invention is defined as a compound containing the acryloyl group ($CH_2{=}CHCO{-}$) or methacryloyl group ($CH_2{=}CCH_3CO{-}$). The Ac group number (acryloyl group number) to be mentioned in the following description denotes the number of acryloyl or methacryloyl groups.

| Illustrated compound No. | Structural formula | Ac group number |
|---|---|---|
| (1) | 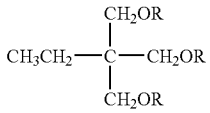 | 3 |

-continued
| Illustrated compound No. | Structural formula | Ac group number |
|---|---|---|
| (2) | $CH_3CH_2-C(CH_2CH(CH_3)OR')_3$ | 3 |
| (3) | $CH_3CH_2-C(CH_2OR')(CH_2CH(CH_3)OR')_2$ | 3 |
| (4) | $CH_3CH_2-C(CH_2CH(CH_3)OR)(CH_2OR)_2$ | 3 |
| (5) | $HOCH_2-C(CH_2OR')_3$ | 3 |
| (6) | $HOCH_2-C(CH_2OR)_2-CH_2OCH_2-C(CH_2OR)_2-CH_2OH$ | 4 |
| (7) | $ROCH_2-C(CH_2OR)_2-CH_2OCH_2-C(CH_2OR)_2-CH_2OH$ | 6 |
| (8) | $(R'OCH_2)_3C-CH_2OCH_2-C(CH_2OR')(R'OC_5H_{10}-C(=O)-O)_2$ | 6 |
| (9) | 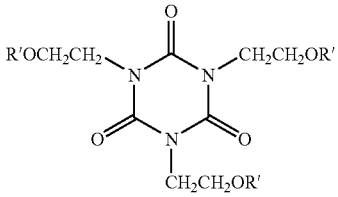 | 3 |
| (10) | $CH_3CH_2C(CH_2OC_3H_6OR)_3$ | 3 |
| (11) | 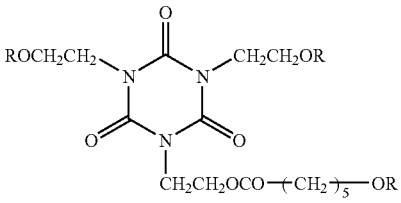 | 3 |
| (12) | $(ROCH_2)_3C-O-C(CH_2OR)_3$ | 6 |
| (13) | $(ROCH_2)_3C-CH_2OCH_2-C(H)(CH_2OR)_2$ | 5 |

-continued
| Illustrated compound No. | Structural formula | Ac group number |
|---|---|---|
| (14) | $(ROCH_2)_3C—CH_2OCH_2—C(CH_3)—(CH_2OR)_2$ | 5 |
| (15) | $(ROCH_2)_3C—CH_2OCH_2—C(CH_2OH)—(CH_2OR)_2$ | 5 |
| (16) | $(R'OCH_2)_3C—CH_2OCH_2—C(CH_2OR')—(CH_2OH)_2$ | 4 |
| (17) | $(ROCH_2)_3C—O—C(CH_2OH)—(CH_2OR)_2$ | 5 |
| (18) | 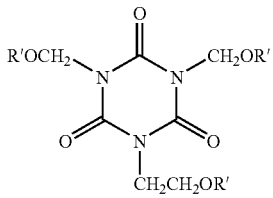 | 3 |
| (19) | $CH_3CH_2C—(CH_2CH_2OR)_3$ | 3 |
| (20) | $HOCH_2—C\left(CH_2O—C(=O)CH_2CH_2CH_2CH_2CH_2OR\right)_3$ | 3 |
| (21) | 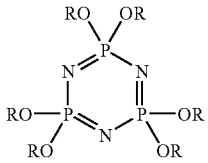 | 6 |
| (22) | 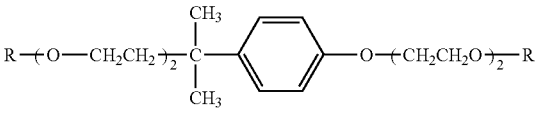 | 2 |
| (23) | 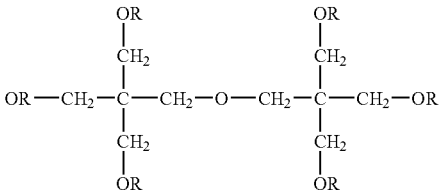 | 6 |
| (24) | 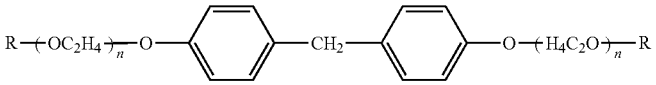 (n ≈ 2) | 2 |
| (25) | 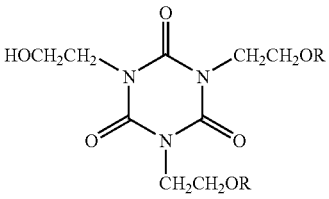 | 2 |

-continued
| Illustrated compound No. | Structural formula | Ac group number |
|---|---|---|
| (26) | $R-(OC_3H_6)_3-OR$ | 2 |
| (27) | 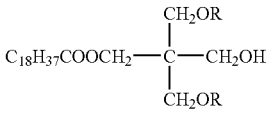 | 2 |
| (28) | 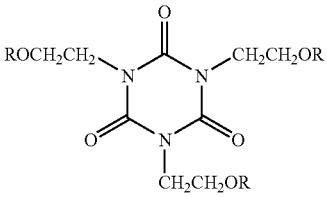 | 3 |
| (29) | $[R-(OC_3H_6)_n-OCH_2]_3CCH_2CH_3$ (n ≈ 3) | 3 |
| (30) | 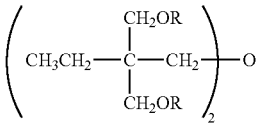 | 4 |
| (31) | $(ROCH_2)_4C$ | 4 |
| (32) | $RO—C_6H_{12}—OR$ | 2 |
| (33) | 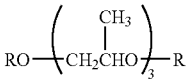 | 2 |
| (34) | 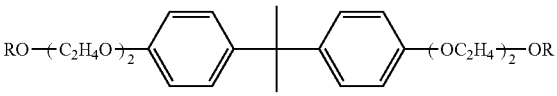 | 2 |
| (35) | 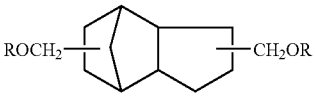 | 2 |
| (36) | $RO-(C_2H_4O)_8-R$ | 2 |
| (37) | 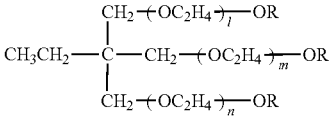 (l + m + n = 3) | 3 |
| (38) | 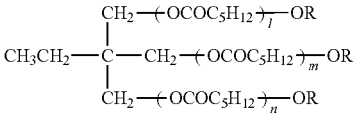 (l + m + n = 3) | 3 |

It should be noted that R and R' in the above description will be shown in the following:

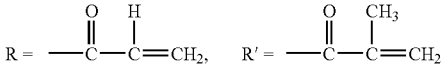

KAYARAD MANDA (by Japan Chemical, a bifunctional acryl monomer having a molecular weight of 312): B-1.

Various forms of reactive oligomer can also be employed. For example, epoxy acrylate oligomer, urethane acrylate oligomer, polyester acrylate oligomer, and unsaturated polyester resin can be used. The following describes the specific examples:

| Illustrated compound No. | Structural formula |
|---|---|
| (39) | 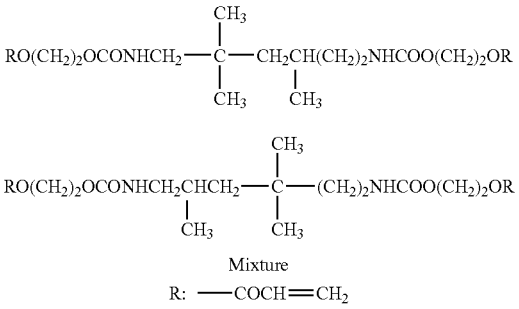 |
| | Mixture<br>R: $—COCH{=}CH_2$ |
| (40) | $(ROCH_2)_3CCH_2OCONH(CH_2)_6NHCOOCH_2C(CH_2OR)_3$<br>R: —COCH═$CH_2$ |

KAYARAD DPCA120 (by Japan Chemical, a hexaacrylate of hexafunctional dipentaerithritol derivative having a molecular weight of 1947): B-2

E8402 (by Daicel Cytec, a bifunctional urethane acrylate having a molecular weight of 1000): B-3.

The aforementioned curable compound is manufactured and marketed by Japan Chemical, Daicel Cytec, and Towa Synthetic Chemical.

In the present invention, the curable compound is preferred to have a tri or higher reactive functional group, and is particularly preferred to have a penta or higher reactive functional group. The curable reaction group equivalent, namely, the "molecular weight of curable compound/the number of reactive functional groups" is preferably 1000 or less, and is particularly preferred to be 500 or less. This increases the crosslinking density, and improves the abrasion resistance of the photoreceptor. If this value is greater, a problem may arise in the durability of the photoreceptor.

In the present invention, two or more curable compounds having different curable reactive group equivalents can be mixed and used.

(Alumina Particles)

In the present invention, alumina particles are used for the protective layer of the photoreceptor. Thus, the hydroxyl group on the surface of the alumina particles is preferably treated by sequestering.

The alumina particles are preferably reinforced by baking to ensure effective hydrophobing of the surface. To provide sufficient strength, the alumina is preferably baked sintered at 500°0 C. or more in the normal condition, and more preferably at 1000° C. or more. The baking time is preferably five hours or more, more preferably ten hours or more. If the alumina is baked under the aforementioned temperature conditions, the functional group such as hydroxyl group present on the surface of alumina will be decomposed and turned into an aluminum oxide. Further, the specific surface area will be reduced and effective hydrophobing can be achieved by a silane compound and others.

In the present invention, surface treatment of the alumina particles is provided in such a way that the surface of the alumina particles is coated with an organic compound, organic metallic compound, fluorine compound, reactive organic silicon compound and others, whereby hydrophobing is performed. It can be accurately verified that the surface of the alumina particles is coated with an organic compound, organic metallic compound, fluorine compound, reactive organic silicon compound and others through the composite use of surface analysis methods such as photoelectronic spectroscopy (ESCA (electron spectroscopy for chemical analysis)), Auger electron spectroscopy, secondary ion mass spectrometry (SIMS), and diffusion/reflection FI-IR.

The number-average particle size of the alumina particles used in the present invention is preferably kept in the range from 1 through 300, more preferably in the range from 3 through 100 nm. If the particle size is smaller, abrasion resistance will be reduced. If the particle size is greater, the writing light is scattered. This may interfere with photocuring of the particles and abrasion resistance.

To get the number-average particle size of the alumina particles, 100 random particles that were magnified 2000 times were observed as primary particles using a transmission electron microscope. Thus, the number-average particle size of the alumina particles was obtained as the average size in the Feret direction by image analysis.

The amount of alumina particles in the protective layer is in the range of 1 through 200 parts by mass, preferably in the range of 10 through 80 parts by mass, with respect to 100 parts by mass of curable acrylic compound.

The protective layer can be coated with a coating solution formed by mixing a polymerization initiator, filler, lubricant particles, and antioxidant, as required, in addition to the aforementioned curable compound and alumina particles, whereby a cured film is formed by the reaction thereof.

The curable compound in the present invention can be put to reaction by electron beam cleavage or by light and heat through addition of a radical polymerization initiator. Either the polymerization initiator or thermal polymerization initiator can be employed. Further, both of these initiators can be used in combination.

The examples of the initiator include:

acetophenone or ketal polymerization initiators such as diethoxy acetophenone, 2,2-dimethoxy-1,2-diphenylethane-1-on, 1-hydroxy-cyclohexyl-phenyl-ketone, 4-(2-hydreoxy-ethoxy)phenyl-(2-hydroxy-2-propyl)ketone, 2-benzyl-2-dimethylamino-1-(4-morpholino phenyl)butanone-1,2-hydroxy-2-methyl-1-phenyl propane-1-on, 2-methyl-2-morpholino (4-methylthiophenyl)propane-1-on, 1-phenyl-1,2-propane dione-2-(o-ethoxy carbonyl)oxime and others;

benzoin ether polymerization initiators such as benzoin, benzoin methyl ether, benzoin ethyl ether, benzoin isobutyl ether, and benzoin isobutyl propyl ether;

benzophenone polymerization initiators such as benzophenone, 4-hydroxy benzophenone, o-benzoyl methyl benzoate, 2-benzoyl naphthalene, 4-benzoyl biphenyl, 4-benzoyl phenyl ether, acrylated benzophenone, and 1,4-benzoyl benzene; and thioxanthone polymerization initiators such as such as 2-isopropyl thioxanthone, 2-chloro thioxanthone, 2,4-dimethyl thioxanthone, 2,4-diethyl thioxanthone, and 2,4-dichloro thioxanthone.

Other photo-polymerization initiators includes ethylanthracene, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine bis(2,4-dimethoxy benzoyl)-2,4,4-trimethyl pentyl phosphine oxide, methyl phenyl glyoxy ester, 9,10-phenanthrene, acridine compound, triazine compound, and imidazole compound. Further, the compound having a photo-polymerization accelerating effect can be used independently or in combination with the aforementioned photo-polymerization initiators. The examples are triethanol amine, methyl diethanol amine, 4-dimethyl amino ethyl benzoate, 4-dimethyl amino isoamyl benzoate, ethyl benzoate (2-dimethyl amino)ethyl, and 4,4'-dimethyl amino benzophenone.

These polymerization initiators each can be used independently or two or more of them can be used in combination. The content of the polymerization initiator is in the range of 0.1 through 20 parts by mass with respect to 100 parts by weight of acrylic compound, preferably in the range of 0.5 through 10 parts by mass.

To improve film strength and to adjust resistance, various forms of fillers can be added. The examples of fillers that can be used include the extra-fine particles of:

various forms of metallic oxides such as silica, alumina, zinc oxide, titanium oxide, tin oxide, antimony oxide, indium oxide, and bismuth oxide;

tin-doped indium oxide;

antimony-doped tin oxide; and zirconium oxide.

These metallic oxides each can be used independently or two or more of them can be used in combination. When two or more of them are used in combination, they can be used as a solid solution or a fused substance. The preferred number-average particle size of the filler is in the range of 1 through 300 nm. The particularly preferred number-average particle size is in the range of 3 through 100 nm. The amount of the filler in the protective layer is in the range of 1 through 100 parts by mass preferably in the range of 10 through 80 parts by mass, with respect to 100 parts by mass of the acrylic compound.

The protective layer in the present invention can be further provided with various forms of electric charge transport substances.

Various forms of lubricant particles can be added to the protective layer in the present invention. For example, resin particles containing fluorine atoms can be added. The resin particles containing fluorine atoms are exemplified by ethylene tetrafluoride resin, ethylene trifluoride resin, ethylene hexafluoride propylene resin, vinyl fluoride resin, vinylidene fluoride resin, and ethylene difluoride dichloro resin. It is preferred that, of these copolymers, one or more should be adequately selected and used. Use of the ethylene tetrafluoride resin, and vinylidene fluoride resin is particular preferred. The amount of the lubricant particles in the protective layer is in the range of 5 through 70 parts by mass, preferably in the range of 10 through 60 parts by mass, with respect to 100 parts by mass of the acrylic compound. The preferred particle size of the lubricant particles is such that the average primary particle size is 0.01 μm through 1 μm. The particularly preferred average primary particle size is 0.05 μm through 0.5 μm. There is no particular restriction to the molecular weight of the resin. A proper molecular weight of the resin can be selected.

An ultrasonic homogenizer, ball mill, sand grinder, and homomixer can be used to disperse the alumina particles of the protective layer, without being restricted thereto.

To improve weatherability of the protective layer in the present invention, such an additive as antioxidant can be added. The same antioxidant as that added to the electric charge transport layer can be selected in this case.

In the present invention, it is possible to use a mixture with other resins such as polyester, polycarbonate, polyurethane, acrylic resin, epoxy resin, silicone resin, alkyd resin, and vinyl chloride-vinyl acetate copolymer, in addition to the curable compound.

The solvent for forming the protective layer is exemplified by methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, and diethyl amine, without being restricted thereto.

After having been coated, the protective layer of the present invention should be subjected to natural drying or heat drying. After that, the protective layer is preferably made to react by exposure to actinic radiation.

Similarly to the case of the intermediate layer and photosensitive layer, the protective layer can be coated according to such commonly known methods as dip coating, spray coating, spinner coating, bead coating, blade coating, beam coating, and slide hopper coating methods.

For the photoreceptor of the present invention, the following step is preferably used: Actinic radiation is applied to a coating film to generate radicals and cause polymerization. Intermolecular and intramolecular crosslinking is formed by a crosslinking reaction, and curing is performed to generate a cured resin. It is preferred in particular to use an ultraviolet ray and electron beam as actinic radiation.

There is no particular restriction to the ultraviolet light source if ultraviolet rays can be emitted. It is possible to use a low pressure mercury lamp, intermediate pressure mercury lamp, high pressure mercury lamp, extra-high pressure mercury lamp, carbon arc lamp, metal halide lamp, xenon lamp, flash (pulse) xenon and others. Irradiation conditions differ according to each lamp. The dose of actinic radiation is normally in the range of 5 through 500 mJ/cm$^2$, preferably in the range of 5 through 100 mJ/cm$^2$. The electric power of the lamp is preferably in the range of 0.1 kW through 5 kW, more preferably in the range of 0.5 kW through 3 kW.

There is no restriction to the electron beam irradiation apparatus as the electron beam source. Generally, a curtain beam type that produces high power at less costs is effectively used as an electron beam accelerator for emitting the electron beam. The acceleration voltage at the time of electron beam irradiation is preferably in the range of 100 through 300 kV. The absorbed dose is preferably kept in the range of 0.5 through 10 Mrad.

The irradiation time to get the required dose of actinic radiation is preferably in the range of 0.1 sec to 10 min., and is more preferably in the range of 0.1 sec to 5 min.

Ultraviolet rays are easy to use as actinic radiation, and are preferably used.

The photoreceptor of the present invention can be dried before and during irradiation with actinic radiation. Appropriate time intervals for drying can be selected by a combination thereof.

Appropriate drying conditions can be selected according to the type of solvent and film thickness. The drying temperature is preferably in the range of the room temperature through 180° C., more preferably in the range of 80° C. through 140° C. Drying time is preferably in the range of 1 min through 200 min, more preferably in the range of 5 min through 100 min.

The film thickness of the protective layer is preferably in the range of 0.2 through 10 μm, more preferably in the range of 0.5 through 6 μm.

[Conductive Support Member]

There is no restriction to the support member used in the present invention if it is conductive. The examples are:

a drum or cylinder formed of such a metal as aluminum, copper, chromium, nickel, zinc and stainless steel;

a plastic film laminated with such a metallic film as aluminum and copper;

a plastic film provided with vapor deposition of aluminum, indium oxide, and tin oxide; and a metal, plastic film, or paper provided with a conductive layer by coating a conductive substance independently or in combination with a binder resin.

[Intermediate Layer]

In the present invention, an intermediate layer having a barrier function and bonding function can be provided between the conductive layer and photosensitive layer.

To form the intermediate layer, such a binder resin as casein, polyvinyl alcohol, nitrocellulose, ethylene-acrylic acid copolymer, polyamide, polyurethane or gelatin is dissolved in the commonly known solvent, and the intermediate layer can be formed by dip coating. Of these materials, alcohol soluble polyamide resin is preferably used.

Various forms of conductive fine particles and metallic oxides can be added to adjust the resistance of the intermediate layer. Examples are such metallic oxides as alumina, zinc oxide, titanium oxide, tin oxide, antimony oxide, indium oxide, and bismuth oxide. Examples also include extra-fine particles of tin-doped indium oxide, antimony-doped tin oxide, and zirconium oxide.

These metallic oxides each can be used independently or two or more of them can be used in combination. When two or more of them are used in combination, they can be used in the form of a solid solution or a fused substance. The preferred average particle size of such metallic oxide is preferably 0.3 μm or less, more preferably 0.1 μm or less.

The solvent used in the intermediate layer is preferably capable of effective dispersion of inorganic particles and dissolution of polyamide resin. To put it more specifically, the preferred solvent characterized by excellent polyamide resin dissolution and coating performances is exemplified by alcohols containing 2 through 4 carbon atoms such as ethanol, n-propyl alcohol, isopropyl alcohol, n-butanol, t-butanol, and sec-butanol. Further, to improve the keeping quality and particle dispersion, it is possible to use an auxiliary solvent providing excellent effects when used in combination with the aforementioned solvent. The examples of such an auxiliary solvent are methanol, benzyl alcohol, toluene, methylene chloride, cyclohexane, and tetrahydrofuran.

The density of the binder resin is selected as appropriate in conformity to the film thickness of the intermediate layer and production speed.

When inorganic particles are dispersed in the binder resin, the amount of the mixed inorganic resin is preferably in the range of 20 through 400 parts by mass, more preferably in the range of 50 through 200 parts by mass, with respect to 100 parts by mass of the binder resin.

An ultrasonic homogenizer, ball mill, sand grinder, and homomixer can be used to disperse the inorganic particles, without being restricted thereto.

The method of drying the intermediate layer can be selected as appropriate in conformity to the type of solvent and film thickness. The method of drying by heat is preferably used.

The film thickness of the intermediate layer is preferably in the range of 0.1 through 15 μm, more preferably in the range of 0.3 through 10 μm.

[Electric Charge Generation Layer]

The electric charge generation layer preferably used in the present invention is the layer that contains the electric charge generation substance and binder resin, and is formed by dispersing the electric charge generation substance in the binder resin solution, and coating the same.

The electric charge generation substance is exemplified by an azo material such as Sudan Red and Diane Blue; quinone pigment such as bilene quinone and anthoanthrone; quinocyanine pigment; perylene pigment; indigo pigment such as indigo, and thioindigo; and phthalocyanine pigment, without being restricted thereto. These electric charge generation substances can be used independently or in the form dispersed in the commonly known resin.

The conventionally known resin can be used as the binder resin of the electric charge generation layer. Such a resin is exemplified by polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (e.g., vinyl chloride-vinyl acetate copolymer, vinyl chloride-vinyl acetate-anhydrous maleic acid copolymer), and polyvinyl carbazole resin, without being restricted thereto.

The electric charge generation layer is preferably formed as follows: The electric charge generation substance is dispersed by a homogenizer into the solution obtained by dissolving binder resin in solvent, whereby a coating solution is prepared. Then the coating solution is coated to a predetermined thickness using a coating device. After that, the coating film is dried, whereby the electric charge generation layer is formed.

The examples of the solvent used for dissolving the binder resin used in the electric charge generation layer and coating include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrazine, 1-dioxane, 1,3-dioxolane, pyridine and diethyl amine, without being restricted thereto.

An ultrasonic homogenizer, ball mill, sand grinder, and homomixer can be used to disperse the electric charge generation substance, without being restricted thereto.

The amount of the electric charge generation substance is preferably in the range of 1 through 600 parts by mass of the electric charge generation substance, more preferably in the range of 50 through 500, with respect to 100 parts by mass of binder resin. The film thickness of the electric charge generation layer differs according to the characteristics of the electric charge generation substance and binder resin and percentage of mixture, and is preferably 0.01 through 5 μm, more preferably 0.05 through 3 μm. An image defect can be prevented from occurring by filtering out the foreign substances and coagulants before applying the coating solution for the electric charge generation layer. It can be formed by vacuum evaporation coating of the aforementioned pigment.

[Electric Charge Transport Layer]

The electric charge transport layer used in the photosensitive layer of the present invention contains an electric charge transport substance and binder resin, and is formed by dissolving the electric charge transport substance in the binder resin and coating the same.

The electric charge transport substance is exemplified by carbazole derivative, oxazole derivative, oxadiazole derivative, thiazole derivative, thiadizole derivative, triazole derivative, imidazole derivative, imidazolone derivative, imidazolidine derivative, bisimidazolidine derivative, styryl compound, hydrazone compound, pyrazoline compound, oxazolone derivative, benzoimidazole derivative, quinazoline derivative, benzofuran derivative, acridine derivative, phenazine derivative, aminostilbene derivative, triaryl amine derivative, phenylene diamine derivative, stilbene derivative, benzidine derivative, poly-N-vinyl carbazole, poly-1-vinyl pyrene, and poly-9-vinyl anthracene. Two or more of these substances can be mixed for use.

The conventionally known resin can be used as the binder resin for the electric charge transport layer. The examples include polycarbonate resin, polyacrylate resin, polyester resin, polystyrene resin, styrene-acrylnitryl copolymer resin, polymethacrylate ester resin, and styrene-methacrylate ester copolymer. Polycarbonate is preferably used. Further, BPA, BPZ, dimethyl BPA, and BPA-dimethyl BPA copolymers are preferably used because of excellent resistance to cracks and abrasion, and superb antistatic performances.

The electric charge transport layer is preferably formed by dissolving binder resin and an electric charge transport substance to prepare a coating solution, which is then applied to the layer to a predetermined thickness. Then the coating film is dried.

The examples of the solvent for dissolving the aforementioned binder resin and electric charge transport substances include toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine, and diethyl amine, without being restricted thereto.

The amount of electric charge transport substance is preferably in the range of 10 through 500 parts by mass of electric charge transport substance, more preferably in the range of 20 through 100 parts by mass, with respect to 100 parts by mass of binder resin.

The film thickness of the electric charge transport layer differs according to the characteristics of the electric charge transport substance and binder resin, and percentage of mixture, and is preferably 5 through 40 μm, more preferably 10 through 30 μm.

An antioxidant, electronic conductive agent, and stabilizer can be applied to the electric charge transport layer. The antioxidants listed in the Japanese Patent Application No. Hei 11-200135, and electronic conductive agents listed in the Unexamined Japanese Patent Application Publication No. Sho 50-137543 and 58-76483 are preferably used.

[Toner Preparation Method]

There is no particular restriction to the method of preparing the toner. The emulsion association method is preferably employed. Particularly preferred is the method for associating (coagulating and fusing) the resin particles obtained by forming mini-emulsion polymerizable particles into a multi-step polymerization structure by emulsion polymerization.

The following describes the details of an example of the method for preparing toner by the emulsion polymerization association method. In this method, toner is prepared through the following steps:

(1) Dissolution/dispersion step wherein a mold releasing agent is dissolved or dispersed in the radical polymerizable monomer (2) Polymerization step wherein the polymerizable monomer solution with a mold releasing agent dissolved and dispersed therein is turned into liquid particles in the solution medium (3) Coloring agent dispersion step wherein the coloring agent is dispersed in the solution medium contained (4) Coagulation/fusion step wherein the resin particles and coloring agent particles are associated in the solution medium to produce associated particles (5) Curing step wherein the associated particles are cured by thermal energy and are reshaped to get toner particles (6) Cooling step for cooling the dispersion liquid of toner particles (7) Cleaning step wherein the toner particles are subjected to solid/liquid separation from the dispersion liquid of the cooled toner particles, and the surface active agent is removed from the matrix of the toner (8) Drying step for drying the cleaned toner particles (9) Step for adding an external additive agent to the dried toner particles The following describes each step:

(1) Dissolution/Dispersion Step

In this step, a mold releasing agent is dissolved or dispersed into the radical polymerizable monomer, and the radical polymerizable monomer solution of the mold releasing agent is prepared.

(2) Polymerization Step

In a preferred example of the polymerization step, the radical polymerizable monomer solution with the mold releasing agent dissolved and dispersed therein is added to the solution medium containing the surface active agent, and liquid particles are produced by application of mechanical energy. Then the polymerization reaction is performed in the liquid particles by the radical from the water soluble radical polymerization initiator. Resin particles can be added to the solution medium as the nuclear particles.

The aforementioned polymerization step produces the resin particles containing the mold releasing agent and bonding resin. Such resin particles can be colored or uncolored. The colored resin particles are obtained by polymerization of the monomer composition containing the coloring agent. When the uncolored resin particles are utilized, the dispersion liquid of the coloring agent particles is added to the dispersion liquid of resin particles in the coagulation step (to be described later), and resin particles and coloring agent particles are coagulated, whereby colored particles are obtained.

(3) Coloring Agent Particle Dispersion Step

In this step, coloring agent particles are added into the solution medium containing the surface active agent, and the coloring agent particles are dispersed in the solution medium using the homogenizer.

There is no particular restriction to the type of the homogenizer used in the step of dispersing the coloring agent particles. A conventionally known homogenizer can be used. Preferred examples are a pressurizing type homogenizer such as an ultrasonic homogenizer, mechanical homogenizer, Manton-Gaulin homogenizer and pressure type homogenizer, and a medium type homogenizer such as a sand grinder, Getzmann mill, and diamond fine mill.

The coloring agent can be subjected to surface modification. In the surface modification method of the coloring agent, coloring agent particles are dispersed in the solvent and a surface modification agent is added into the dispersion liquid. This system is then heated to cause a reaction. After reaction, the coloring agent particles are filtered out, and cleaning and filtration are repeated using the same solvent. This is followed by the drying step. This procedure provides a coloring agent processed by the surface modification agent.

To enhance the advantages of the present invention, the average dispersion diameter of the coloring agent dispersed in the liquid medium at the time of toner production is preferably in the range of 2 through 300 nm, more preferably in the range of 2 through 200 nm. The average dispersion diameter of the coloring agent can be adjusted in conformity to the type and amount of the compound, the amount of surface active agent, the speed of homogenizer, and dispersion time.

(4) Coagulation/Fusion Step

The coagulation step is used to form the colored particles using the resin particles obtained in the polymerization step, and coloring agent. This coagulation step also coagulates such an internal additive agent as mold releasing agent particles and electric charge regulating agents, together with the resin particles and coloring agent particles.

In a preferred coagulation method, the salting agent consisting of alkali metallic salt and alkali earth metal as a coagulant having a density equal to or higher than the critical coagulation density is added into water containing resin particles and coloring agent particles. This solution is heated up to the temperature equal to or higher than the glass-transition temperature of the resin particles and the melting peak temperature (° C.) of the mold releasing agent, whereby coagulation is performed.

(5) Curing Step

Curing is preferably performed by thermal energy (by heating).

To put it more specifically, the liquid containing the associated particles is heated and stirred, and is adjusted in terms of heating temperature, stirring speed, and heating time until the shape of the associated particles is modified to have a desired circularity, whereby toner particles are obtained.

(6) Cooling Step

In the cooling step, the dispersion liquid of the toner particles is cooled (quenched). Cooling is performed at a cooling speed of 1 through 20° C. per minute. There is no particular restriction to the cooling method. Examples include the method of introducing coolant from outside the reaction container, and the method of putting cold water directly into a reaction system.

(7) Cleaning Step

The solid/liquid separation and cleaning step includes the solid/liquid separation step wherein the toner particles are subjected to solid/liquid separation from the dispersion liquid of the toner particles cooled down to a predetermined temperature in the aforementioned step, and the cleaning step wherein such adherents as surface active agents and salting agents, and alkali agents used in the curing step are removed from the toner cake (aggregate obtained by coagulating the wet toner particles into cakes) subjected to solid/liquid separation.

In the cleaning step, water cleaning is performed until the electric conductivity of the filtrate reaches 10 μS/cm. There is no particular restriction to the filtration method. The examples of filtration methods include the centrifugal separation method, vacuum filtration method using Nutsche and others, and a filtration method using a filter press.

(8) Drying Step

In this step, the toner cake having been cleaned is dried to get dried tone particles. The examples of the dryers used in this step include a spray dryer, vacuum freeze dryer, and vacuum dryer. The preferably used dryers are a standing rack dryer, traveling rack dryer, fluidized-bed dryer, rotary dryer, and stirring dryer. The amount of water content in the dried colored particles is preferably 5 wt % or less, more preferably 2 wt % or less. When the dried toner particles coagulate due to a small force of mutual attraction, these coagula can be crushed. The examples of available crushers include a mechanical crusher as a jet mill, Henschel mixer, coffee mixer, and food processor.

(9) External Additive Agent Adding Step

Metallic oxide and metallic soap can be added to the toner using various forms of conventionally known mixing apparatuses such as a turbular-mixer, Henschel mixer, Nauter mixer, and V-shaped mixer.

The median diameter (D50) in the toner volume standard is obtained by the measurement according to the following measuring method.

For measurement and calculation, the computer system (by Coulter Inc.) with the data processing software (Software V3.51) mounted thereon is connected to the Coulter Multisizer 3 (by Coulter Inc.).

Measurement Procedure

After 0.02 g of toner has been made to conform to 20 ml of surface active agent solution (the surface active agent solution obtained by diluting the neutral detergent including the surface active agent component in pure water to a ratio of 1 to 10 for the purpose of dispersing the toner), the toner dispersion liquid is prepared by a one-minute ultrasonic dispersion. This toner dispersion liquid is put into a beaker containing ISOTONII (by Coulter Inc.) inside the sample stand by a pipette until the density indicated on the measuring instrument reaches 5% through 10%. Reproducible measurements can be obtained by maintaining the range. In the measuring instrument, the count of the measured particles is set to 25000, the aperture diameter is set to 50 μm, and the range of measurement of 1 through 30 μm is divided into 256 parts, whereby a frequency value is obtained. As counted from the measurements having a greater integrated volume fraction, 50% particle diameter is assumed as the volume standard median diameter.

The following describes the materials for constituting the toner particles:

(Binder Resin)

The examples of the substances used as the polymerizable monomer constituting the binder resin include:

styrene or styrene derivatives such as styrene, o-methyl styrene, m-methyl styrene, p-methyl styrene, α-methyl styrene, p-chloro styrene, 3,4-dichloro styrene, p-phenyl styrene, p-ethyl styrene, 2,4-dimethyl styrene, p-tert-butyl styrene, p-n-hexyl styrene, p-n-oxtyl styrene, p-n-nonyl styrene, p-n-desyl styrene, and p-n-dodesyl styrene;

methacrylic acid ester such as methyl methacrylate, ethyl methacrylate, n-butyl methacrylate, isopropyl methacrylate, isobutyl methacrylate, t-butyl methacrylate, n-octyl methacrylate, 2-ethylbexyl methacrylate, stearyl methacrylate, lauryl methacrylate, phenyl methacrylate, diethyl aminoethyl methacrylate, and dimethyl aminoethyl methacrylate;

acrylic acid ester such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate;

olefins such as ethylene, propylene, and isobutylene;

halogen vinyls such as vinyl chloride, vinylidene chloride, vinyl bromide, vinyl fluoride, and vinylidene fluoride;

vinyl esters such as vinyl propionate, vinyl acetate, and vinyl benzoate;

vinyl ethers such as vinyl methyl ether, and vinyl ethyl ether;

vinyl ketones such as vinyl methyl ketone, vinyl ethyl ketone, and vinyl hexyl ketone;

N-vinyl compounds such as N-vinyl carbazole, N-vinyl indole, and N-vinyl pyrrolidone;

vinyl compounds such as vinyl naphthalene and vinyl pyridine;

acrylic acids such as acrylonitrile and acryl amide; and methacrylic acid derivatives.

A combination of substances having an ionic dissociable group is more preferably used as the polymerizable monomer constituting a resin. The examples include substances having substituents of the carboxyl group, sulfonic acid group, and phosphoric acid group as the constituent group of the monomer. Specific examples are acrylic acid, methacrylic acid, maleic acid, itaconic acid, cinnamic acid, fumaric acid, monoalkyl maleate ester, monoalkyl itaconate ester, styrene sulfonic acid, allyl sulfosuccinic acid, 2-acryl amide-2-methyl propane sulfonic acid, acid phosphooxyethyl methacrylate, and 3-chloro-2-acid phosphooxypropyl methacrylate.

Further, the resin of the crosslinking structure can be formed by using multifunctional vinyls such as divinyl benzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

These polymerizable monomers can be polymerized by the radical polymerization initiator. In this case, the examples of oil soluble polymerization initiators include:

azo or diazo-polymerization initiators such as 2,2'-azobis-(2,4-dimethyl valeronitrile), 2,2'-azobis isobutyl nitrile, 1,1'-azobis(cyclohexane-1-carbonitryle), 2,2'-azobis-4-methoxy-2,4-dimethyl valeronitrile, and azobis isobutylonitrile; and peroxide polymerization initiators such as benzoyl peroxide, methyl ethyl ketone peroxide, diisopropyl peroxy carbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butyl peroxycyclohexyl)propane, and tris-(t-butyl peroxy)triazine.

When the emulsion polymerization method is used, the water soluble radical polymerization initiator can be employed. The water soluble radical polymerization initiator is exemplified by persulfates such as potassium persulfate and ammonium persulfate, azobis amino dipropane acetate, azobis cyano valeric acid, salts thereof, and hydrogen petroxide.

(Example of Chain-Transfer Agent)

The chain-transfer agent can generally be used to adjust the molecular weight of the resin. There is no particular restriction to the chain-transfer agent that can be used. The examples are mercaptans such as n-octyl mercaptan, n-desyl mercaptan, and tert-dodesyl mercaptan; mercapto propanoic acid esters such as n-octyl-3-mercapto propanoic acid ester; terpinolene, carbon tetrabromide, and α-methyl styrene dimer.

(Coloring Agent)

There is no particular restriction to the coloring agent used in the present invention. Commonly used coloring agents can be utilized.

One of these coloring agents can be used independently or two or more can be used in combination, as required. The amount of the coloring agent to be added is 1 through 30% by mass, preferably 2 through 20% by mass, with respect to the total amount of toner.

(Mold Releasing Agent)

Conventionally known compounds can be used as the mold releasing agent used in the present invention.

These compounds include:

polyolefin wax such as polyethylene wax and polypropylene wax;

long chain hydrocarbon wax such as paraffin wax and sazol wax;

dialkyl ketone wax such as distearyl ketone;

ester wax such as carnauba wax, montan wax, trimethylol propane tribehenate, pentaerithritol tetrabehenate, pentaerithritol diacetate dibehenate, glycerine tribehenate, 1,18-octadecane diol distearate, tristearyl trimellitate, and distearyl maleate; and amide wax such as ethylene diamine behenylamide and tristearylamide trimellitate.

The amount of the mold releasing agent contained in the toner is preferably 1 through 20% by mass, more preferably 3 through 15% by mass, with respect to the entire toner.

(Electric Charge Regulating Agent)

Electric charge regulating agent can be added to the toner of the present invention, as required.

[Developer]

The toner of the present invention can be used in the form of a one-component developer and two-component developer.

The one-component developer to be used includes the non-magnetic one-component developer and the magnetic one-component developer formed by about 0.1 μm through 0.5 μm of magnetic particles contained in the toner. Both of them can be used.

The developer can be mixed with a carrier and can be used as a two-component developer. Examples of the carrier are conventionally known magnetic particles as exemplified by metals such as iron, ferrite and magnetite, and alloys between these metals and such metals as aluminum and lead. Use of the ferrite particles is preferred in particular. The particle size of the aforementioned carrier is preferably 20 through 100 μm in terms of mass-average particle size, more preferably 20 through 70 μm.

The carrier particle size can be measured typically by the laser diffraction type particle size distribution measuring instrument "Helos" (by Sympatec Inc.).

The preferred carrier is the one whose magnetic particles are coated further with resin, or the so-called resin dispersed carrier wherein magnetic particles are dispersed in resin. There is no particular restriction to the type of the resin for coating. For example, olefin resin, styrene resin, styrene-acrylic resin, silicone resin, ester resin, or fluorine-containing polymer resin are often used. Further, there is no particular restriction to the type of the resins for constituting the resin dispersed carrier. The conventionally known resins can be used. Examples are styrene-acrylic resin, polyester resin, fluorine resin, and phenol resin. The carrier coated with styrene-acrylic resin out of these examples is preferably used because of the excellent performances in preventing the external additive agent from being separated, or in enhancing durability.

[Metallic Oxide (External Additive Agent)]

The substances constituting the metallic oxides externally added to the toner of the present invention are exemplified by silica, alumina, titania, zirconia, magnesium hydroxide, calcium hydroxide, barium titanate, aluminum titanate, strontium titanate, magnesium titanate, magnesium oxide, cerium oxide, zinc oxide, chromium oxide, antimony oxide, tungsten oxide, tin oxide, tellurium oxide, and manganese oxide.

It is also possible to use the aforementioned metallic oxides subjected to the process of hydrophobing. The process of hydrophobing is preferably implemented by the so-called coupling agent such as various forms of titanium coupling agents and silane coupling agent. The higher aliphatic metallic salt is also used with preference. The amount of the metallic oxide to be added in the toner is preferably 0.10 through 10.0% by mass, more preferably 0.50 through 5.0% by mass.

The metallic oxide is added in the form of particles having a number-average particle size of 3.0 through 300 nm. The particles having a particle size of 80 through 300 nm, and the external additive agent having a smaller particle size can be used in combination.

The following describes the method of measuring the number-average particle size:

A scanning electron microscope is used to take a photograph enlarged to 30,000 times the actual size. The image of this photograph is captured by a scanner. The external additive agent present on the toner surface of this photographic image is subjected to the process of binarization by the image processing analyzer LUZEX AP (by Nireco Inc.). The horizontal Feret's diameters of 100 inorganic particles for each type are calculated and the average value thereof is assumed as the number-average particle size. When inorganic particles are present on the toner surface as some coagula, the diameters of the primary particles constituting the coagula are measured.

[Metallic Soap]

In addition to the aforementioned inorganic external additive agents, metallic soap (lubricant) can be added to the toner of the present invention. The metallic soap is a metallic salt of higher aliphatic acid as exemplified by:

salts of stearic acid with zinc, aluminum, copper, magnesium, and calcium;

salts of oleic acid with zinc, manganese, iron, copper, and magnesium;

salts of palmitic acid with zinc, copper, magnesium, and calcium;

salts of linolic acid with zinc and calcium; and salts of recinoleic acid with zinc and calcium;

The amount of the metallic soap to be added is preferably 0.01 through 5% by mass with respect to the toner.

The metallic soap is added into the toner particles in some cases, as in the case of the aforementioned mold releasing agent. The present invention does not preclude this procedure.

[Addition of Metallic Oxide and Metallic Soap]

Metallic oxide and metallic soap can be added to the toner using various forms of conventionally known mixing apparatuses such as a turbular-mixer, Henschel mixer, Nauter mixer, and V-shaped mixer.

[Intermediate Transfer Member]

For the intermediate transfer member, the toner on the intermediate transfer member having been transferred from the photoreceptor is secondarily transferred onto the transfer member. After that, the toner remaining without being transferred onto the intermediate transfer member is removed by the cleaning member (e.g., a cleaning blade and a fur brush). When the remaining toner has been removed without the surface of the intermediate transfer member being damaged by the cleaning member, outputs are printed on several sheets of paper, free from contamination of the printed image due to a cleaning failure. This procedure provides high-quality images on a continuous basis.

Further, the intermediate transfer member ensures improvements to secondary transfer efficiency and a reduction in the attachment of foreign substances, when a low surface energy layer is provided on the surface.

The intermediate transfer member of the present invention is preferably provided with the following characteristics:

1. An elastic layer is arranged on the outer periphery of the resin base, and a surface layer is provided thereon.

2. The thickness of the surface layer is 10 through 500 nm, preferably 30 through 300 nm.

3. The Young's modulus of the surface of the intermediate transfer member measured by the nano-indentation method is 0.1 through 5.0 GPa, preferably 0.1 through 1.0 GPa.

4. The Young's modulus of the surface of the intermediate transfer member measured by the nano-indentation method is 0.0 through 2.0 GPa, preferably 0.0 through 1.0 GPa, greater than that of the elastic layer measured by the nano-indentation method.

When the aforementioned characteristics are provided, high transfer characteristics are ensured despite repeated printing on a great number of sheets of paper, and a high-quality toner image is provided free from the possible dropout of a test image, without any damage caused by the operation of the cleaning member.

The intermediate transfer member of the present invention is preferably provided with an elastic layer on the outer periphery of the resin base, with a surface layer provided thereon. It should be noted that the surface layer is composed of one or more layers of rigid layers, or one or more layers of rigid layers and a low surface energy layer.

(Resin Base)

The resin base is designed in a rigid structure to prevent the intermediate transfer member from being deformed by the load applied to the intermediate transfer member from the cleaning blade as a cleaning member, whereby the impact on the transfer section is minimized. The resin base is preferably formed using the material having a Young's modulus of 5.0 through 15.0 GPa, according to the measurement by the nano-indentation method. More preferably, this material has a Young's modulus of 8.0 through 15.0 GPa.

The materials having such performance are exemplified resins such as polycarbonate, polyphenylene sulfide, vinylidene polyfluoride, polyimide, polyether, and ether ketone. Of these materials, polyimide, polycarbonate, and polyphenylene sulfide are preferably used. These materials have a Young's modulus exceeding 5.0 GPa according to the measurement by the nano-indentation method, and a thickness of 50 through 200 μm. They satisfy the requirements for the mechanical characteristics of the resin base.

The resin base of the present invention is preferably designed as a seamless belt or drum formed by adding a conductive substance added to the resin material so as to have an electric resistance (volume resistivity) of $10^5$ through $10^{11}$ Ω·cm.

Carbon black can be used as a conductive substance added to the resin material. In this case, the neutral or acid carbon black can be used. The amount of the conductive substance to be used differs according to the type of the conductive material to be used. The preferred amount of the conductive substance is such that the volume resistivity and surface resistance of the intermediate transfer member are kept within a predetermined range. Normally, the amount of the conductive substance to be added is kept in the range of 10 through 20, preferably in the range of 10 through 16 parts by mass, with respect to 100 parts by mass of resin material.

(Elastic Layer)

The elastic layer of the present invention can be formed of at least one of the chloroprene rubber, nitrile rubber, styrene butadiene rubber, silicone rubber, and urethane rubber.

The elastic layer can be the layer formed of a mixture of the aforementioned resin materials and elastic materials. The examples of the elastic layer are polyurethane, polyisoprene chloride, nitrile rubber, chloroprene rubber, ethylene-propylene-diene rubber, hydrogenated polybutadiene, butyl rubber, and silicone rubber. One of them can be used independently or two or more of them can be used in combination.

The Young's modulus of the elastic layer measured by the nano-indentation method is preferably 0.1 through 2.0 GPa, more preferably 0.1 through 1.0 GPa.

The film thickness of the elastic layer is preferably 100 through 500 μm.

The elastic layer of the present invention is preferably formed by dispersing a conductive substance to the elastic material so as to have an electric resistance (volume resistivity) of $10^5$ through $10^{11}$ Ω·cm.

Carbon black, zinc oxide, tin oxide, and silicon can be used as a conductive substance added to the elastic layer. Neutral or acid carbon black can be used as the carbon black. The amount of the conductive substance to be used differs according to the type of the conductive substance to be used. The preferred amount of the conductive substance is such that the volume resistivity and surface resistance of the elastic layer is kept within a predetermined range. Normally, the amount of the conductive substance to be added is kept in the range of 10 through 20, preferably in the range of 10 through 16 parts by mass, with respect to 100 parts by mass of the elastic material.

(Surface Layer)

The surface layer is made up of a rigid layer, or a combination of a rigid layer and low surface energy layer.

The Young's modulus of the surface of the intermediate transfer member laminating the surface layer measured by the nano-indentation method is preferably 0.1 through 5.0 GPa, more preferably 0.1 through 2.0 GPa, still more preferably 0.1 through 1.0 GPa.

(Rigid Layer)

The rigid layer of the present invention is preferably made of a metallic oxide film, silicon film, or carbon film. The specific examples of the materials are the films of metallic oxides such as silicon oxide, silicon oxynitride, silicon nitride, titanium oxide, titanium oxynitride, titanium nitride, or aluminum oxide. Of these films, the silicon oxide film is preferably used. Further, the inorganic compound made from the mixture thereof is also preferably utilized.

At least one of the rigid layers of the present invention is essential. It is also possible to adopt such a structure that the hardness of the rigid layer or the density increases gradually from immediately above the elastic layer toward the surface of the rigid layer lying at the maximum distance from the elastic layer.

The film thickness of the rigid layer is in the range of 10 through 500 nm, preferably 20 through 400 nm, more preferably 30 through 300 nm.

The value representing the film thickness has been obtained by measurement using the MXP21 (by McScience Inc.). The following describes the specific method of measuring the film thickness:

Copper is used as the target of the radiation source. The operation is performed at 42 kV, 500 mA. A multilayer film parabola mirror is used as the incident monochrometer. The incident slit has a size of 0.05×5 mm, and a photodetecting slit has a size of 0.03 mm×20 mm. Using the 2θ/θ scanning method, the portion from 0 to 5° is measured according to the FT method with a step width of 0.0005° and 10 seconds per step. The Reflectivity Analysis Program Vol. 1 by McScience is used to apply the process of fitting to the reflectivity curve having been obtained. Parameters are calculated in such a way that the residual sum of squares between the actually measured value and fitting curve will be minimized. The thickness of the laminated film is obtained from each parameter.

If the film thickness of the rigid layer is less than 10 nm, durability and surface strength will be insufficient. A scratch will be produced due to transferring to thick paper or the like, and the thin film will be subjected to uneven abrasion in the final phase. This tends to cause a reduction in transfer efficiency and transfer irregularity. If the level of 1000 nm has been exceeded, adhesion and resistance to flexure will be reduced. Accordingly, cracks and separation will easily occur when a great number of sheets are employed. Further, the time required for the growth of film will be longer. This is to be avoided from the viewpoint of productivity.

(Low Surface Energy Layer)

The low surface energy layer of the present invention contains fluorine or silicon. The film thickness of the low surface energy layer is preferably in the range of 1 through 10 nm. There are no particular restrictions to the method of forming the low surface energy layer. The low surface energy layer can be formed by coating the rigid layer with the coating solution containing fluorine or silicon.

The following describes the image forming method and image forming apparatus using the intermediate transfer member of the present invention:

[Image Forming Method and Image Forming Apparatus]

The intermediate transfer member of the present invention is preferably used in the image forming apparatus of a photocopier using the electrophotographic process, printer and facsimile. In the image forming method that can be used, the toner image carried on the surface of the photoreceptor is primarily transferred onto the surface thereof, and the transferred toner image is held there. Then the toner image being held is secondarily transferred onto the surface of the transfer material such as recording paper, using an intermediate transfer member. The intermediate transfer member can be designed in either a belt-like or drum-like structure.

The following describes the image forming apparatus provided with the intermediate transfer member of the present invention, with reference to the tandem full-color photocopier by way of an example:

FIG. 1 is a schematic diagram schematically representing an example of a color image forming apparatus.

This image forming apparatus 1 is what is called a tandem type full-color photocopier, and includes an automatic document feeder 13, document image reader 14, a plurality of exposure devices 13Y, 13M, 13C, and 13K, a plurality of image forming sections 10Y, 10M, 10C and 10K, intermediate transfer unit 17, sheet feeding device 15, and fixing device 124.

The automatic document feeder 13 and document image reader 14 are arranged on the upper portion of the main unit 12 of the image forming apparatus. The image of the document d having been fed by the automatic document feeder 13 is reflected and formed by the optical system of the document image reader 14. It is then captured by the line image sensor CCD.

The document image having been captured by the line image sensor CCD is subjected to photoelectric conversion, and is formed into an analog signal. This analog signal is subjected to analog processing, analog-to-digital conversion shading correction, and image compression in the image processing section (not illustrated). This signal is then sent to the exposure devices 13Y, 13M, 13C, and 13K as digital image data for each color, and the latent images of the image data of each color are formed on the drum-like photoreceptors (hereinafter referred to as "photoreceptors") 11Y, 11M, 11C, and 11K by the exposure devices 13Y, 13M, 13C, and 13K.

The image forming sections 10Y, 10M, 10C, and 10K are arranged in a single file in the vertical direction. The intermediate transfer member (hereinafter referred to as "intermediate transfer belt") 170 of the present invention as a semiconducting, seamless belt-like second image carrier is arranged on the illustrated left side of the photoreceptors 11Y, 11M, 11C, and 11K, wherein the intermediate transfer member winds the rollers 171, 172, 173, and 174 and is rotatably applied to those rollers.

The intermediate transfer belt 170 of the present invention is driven in the direction of arrow through a roller 171 driven by a drive apparatus (not illustrated).

The image forming section 10Y for forming a yellow image is provided with a charging device 12Y, exposure device 13Y, development device 14Y, primary transfer roller 15Y as a primary transfer device, and cleaning device 16Y which are arranged around the photoreceptor 11Y.

The image forming section 10M for forming a magenta image is provided with a charging device 12M, exposure device 13M, development device 14M, primary transfer roller 15M as a primary transfer device, and cleaning device 16M which are arranged around the photoreceptor 11M.

The image forming section 10C for forming a cyan image is provided with a charging device 12C, exposure device 13C, development device 14C, primary transfer roller 15C as a primary transfer device, and cleaning device 16C which are arranged around the photoreceptor 11C.

The image forming section 10K for forming a black image is provided with a charging device 12K, exposure device 13K, development device 14K, primary transfer roller 15K as a primary transfer device, and cleaning device 16K which are arranged around the photoreceptor 11K.

The toner supply devices 141Y, 141M, 141C, and 141K supply a new toner to the development apparatuses 14Y, 14M, 14C, and 14K, respectively.

The primary transfer rollers 15Y, 15M, 15C, and 15K are operated on a selective basis according to the type of the image by a controller (not illustrated) and press the intermediate transfer belt 170 against corresponding photoreceptors 11Y, 11M, 11C, and 11K, whereby images are transferred onto the photoreceptors.

The images of various colors formed on the photoreceptors 11Y, 11M, 11C, and 11K by the image forming sections 10Y, 10M, 10C, and 10K are sequentially transferred onto the rotating intermediate transfer belt 170 by the primary transfer rollers 15Y, 15M, 15C, and 15K, whereby a composite color image is formed.

The toner image carried on the surface of the photoreceptor is primarily transferred onto the surface of the intermediate transfer belt, which holds the toner image having been transferred thereon.

The transfer material P as a recording medium stored in a sheet feed cassette 151 is fed by the sheet feed device 15, and is then fed to the secondary transfer roller 117 as a secondary transfer device through a plurality of intermediate rollers 122A, 122B, 122C, and 122D and a registration roller 123. Then the toner images combined on the intermediate transfer member are collectively transferred onto the transfer material P by the secondary transfer roller 117.

Namely, the toner image held on the intermediate transfer member is secondarily transferred onto the surface of a device designed to receive the transferred image.

The secondary transfer device 6 allows the transfer material P to be pressed against the intermediate transfer belt 170 only when the transfer material P passes through the secondary transfer device 6, and secondary transfer is performed.

The transfer material P with the color image transferred thereon is fixed by the fixing device 124. Being sandwiched by an ejection roller 125, the transfer material P is then placed on the ejection tray 126 located outside the machine.

In the meantime, after the color image has been transferred onto the transfer material P by the secondary transfer roller 117, the transfer material P is subjected to curvature-separation by the intermediate transfer belt 170, from which the remaining toner is removed by a cleaning device 8.

In this case, the intermediate transfer member can be replaced by a rotating drum-like device, as mentioned above.

The following describes the structure of the primary transfer rollers 15Y, 15M, 15C, and 15K as primary transfer devices in contact with the intermediate transfer belt 170, and the secondary transfer roller 117.

The primary transfer rollers 15Y, 15M, 15C, and 15K are formed by coating the peripheral surface of the conducting cored bar of stainless steel, for example, having an outer diameter of 8 mm, with the semiconducting elastic rubber by dispersing such a conductive material as carbon on the rubber material of polyurethane, EPDM, and silicone, or impregnating the rubber material with ionic conductive material. In this case the aforementioned semiconducting elastic rubber has a thickness of 5 mm and a hardness of about 20 through 70° (in Asker hardness C).

The secondary transfer roller 117 is formed by coating the peripheral surface of the conducting cored bar of stainless steel, for example, having an outer diameter of 8 mm, with the semiconducting elastic rubber by dispersing such a conductive material as carbon on the rubber material of polyurethane, EPDM, and silicone, or impregnating the rubber material with ionic conductive material. In this case, the aforementioned semiconducting elastic rubber has a thickness of 5 mm and a hardness of about 20 through 70° (in Asker hardness C) in a solid state or foamed sponged state with a volume resistivity of about $10^5$ through $10^9$ Ω·cm.

[Transfer Material]

The transfer material used in the present invention is a support member for holding a toner image and is normally called the image support member, transfer member, or transfer paper. The specific examples are plain paper ranging from thin paper to thick paper, coated printing paper including art paper and coated paper, traditional Japanese paper and postal card available on the market, plastic film for OHP use, and cloth, without being restricted thereto.

EXAMPLES

The following shows typical embodiments of the present invention and describes the structure and advantages of the present invention:

Unless otherwise specified, the term "part(s)" in the following description refers to part(s) by mass, and "%" denotes percentage by mass.

[Production of Colored Particles]

(Preparation of Resin Particles for the Core)

<<Preparation of Resin Particles for the Core 1>>

(1) First Polymerization

In a reaction container provided with a stirring apparatus, temperature sensor, cooling tube, and nitrogen introduction apparatus, 93.8 parts by mass of paraffin wax (HNP-57) (by Japan Seiro Co., Ltd.) as a mold releasing agent was heated to 80° C. and was dissolved in the mixture solution containing 110.9 parts by mass of styrene, 52.8 parts by mass of n-butyl acrylate, and 12.3 parts by mass of methacrylic acid.

A surface active agent solution was prepared by dissolving 2.9 parts by mass of sodium polyoxyethylene (2) dodecyl ether sulfate in 1,340 parts by mass of ion-exchange water.

After this surface active agent solution was heated, the aforementioned polymerizable monomer solution was mixed and dispersed for two hours by a mechanical dispersion unit "Cleamix by M-Tech Inc." having a circulatory path. Then the emulsified liquid including emulsified particles with dispersed particles (245 nm) was prepared.

After 1,460 parts by mass of ion-exchange water was added, the initiator solution formed by dissolving 6 parts by mass of polymerization initiator (potassium persulfate) in 142 parts by mass of ion-exchange water, and 1.8 parts by mass of n-octylmercaptan were added, and were heated to 80° C. After that, this solution was heated and stirred at 80° C. for three hours, whereby polymerization (first polymerization) was carried out to produce resin particles. These resin particles are named the "Resin particles C1".

(2) Second Polymerization (Formation of the External Layer)

The initiator solution formed by dissolving 5.1 parts by mass of potassium persulfate in 197 parts by mass of ion-exchange water was added to the "Resin particles C1" obtained in the aforementioned procedure, and a monomer mixture solution made up of 282.2 parts by mass of styrene, 134.4 parts by mass of n-butylacrylate, 31.4 parts by mass of methacrylic acid, and 4.93 parts by mass of n-octylmercaptan was dripped for one hour at a temperature of 80° C. After dripping, the solution was heated and stirred for two hours, whereby the second polymerization (formation of external layer) was carried out. Then the solution was cooled down to 28° C. to get the "Resin particles for core 1".

The weight-average molecular weight of the "Resin particles for core 1" was 21,300. The mass-average particle size of the composite resin particles constituting the "Resin particles for core 1" was 180 nm. The glass transition temperature (Tg) of these resin particles was 39° C.

(Preparation of Resin Particles for the Shell)

The surface active agent solution obtained by dissolving 2.0 parts by mass of sodium polyoxyethylene (2) dodecyl ether sulfate in 3000 parts by mass of ion-exchange water was poured into a reaction container provided with a stirring apparatus, temperature sensor, cooling tube, and nitrogen introduction apparatus. The solution was stirred at a stirring speed of 230 rpm under the flow of nitrogen, and the internal temperature was raised to 80° C.

The polymerization initiator solution formed by dissolving 10 parts by mass of polymerization initiator (potassium persulfate: KPS) into 200 parts by mass of ion-exchange water was added to this surface active agent solution. A monomer mixture solution made up of 528 parts by mass of styrene, 176 parts by mass of n-butylacrylate, 120 parts by mass of methacrylic acid, and 22 parts by mass of n-octylmercaptan was dripped for three hours. This solution was heated to 80° C. and stirred for one hour, whereby the second polymerization was carried out to prepare resin particles. These resin particles are named the "Resin particles for the shell".

The resin particles for shell had a weight average molecular weight of 12,000, a mass average particle size of 120 nm, and a glass transition temperature (Tg) of 53° C.

[Preparation of the Coloring Agent Dispersion Liquid]

A coloring agent dispersion liquid was prepared using 420 parts by mass of coloring agent, Regal 330R (by Cabot Inc.). This is named the "Coloring agent dispersion liquid C1". The coloring agent of the coloring agent dispersion liquid had an average dispersion size of 150 nm according to the measurement by MicroTrack UPA 150 (by Nikkiso Co., Ltd.)

(Preparation of Colored Particles)

(Preparation of Colored Particles 1)

<<Formation of the Core>>

420.7 parts by mass (in terms of solids) of resin particles for core 1,900 parts by mass of ion exchange water, and 200 parts by mass of coloring agent dispersion liquid C1 were poured into a reaction container provided with a temperature sensor, cooling tube, nitrogen introduction apparatus, and stirring apparatus, and were stirred. After the temperature in the container was adjusted to 30° C., 5 mol/L of sodium hydroxide aqueous solution was added to this solution to get a pH value of 9.

The aqueous solution prepared by dissolving 2 parts by mass of magnesium chloride hexahydrate and 1000 parts by mass of ion exchange water was heated at 30° C. and stirred for ten minutes. After having been left to stand for three minutes, the solution was heated for 60 minutes up to 65° C. Under these conditions, the size of the associated particles was measured by the Coulter Multisizer 31 (by Coulter Inc.). When the median diameter (D50) had reached 5.5 μm, the aqueous solution obtained by dissolving 40.2 parts by mass of sodium chloride in 1000 parts by mass of ion exchange water was added to suspend the growth in particle size. Further, in the curing step, the solution was heated and stirred at a liquid temperature of 70° C. for one hour so that fusion was continued to form Core 1.

The circularity of the core 1 was 0.930 according to the measurement by FPIA2100 (by CisTex).

<<Formation of the Shell Layer (Shelling Operation)>>

Next 50 parts by mass (in terms of solids) of the Resin particles for the shell was added at 65° C., and the aqueous solution prepared by dissolving 2 parts by mass of magnesium chloride hexahydrate and 1000 parts by mass of ion exchange water was added in ten minutes, and then the solution was heated to 70° C. (shelling temperature), and was stirred for one hour, until the resin particles for the shell were fused onto the surface of the core 1. After that, the curing step was performed at 75° C. for 20 minutes, whereby a shell layer was formed.

Here 40.2 parts by mass of sodium chloride was added to the solution, which was then cooled down to 30° C. at a rate of 8° C. per minute, whereby the aqueous solution containing toner matrix particles was obtained.

<<Washing and Drying Step>>

The aqueous solution containing toner matrix particles was subjected to the process of solid/liquid separation by the basket type centrifugal separator, MARK III Type 60×40 (by Matsumoto Machine), and a wet cake of toner matrix particles was prepared. This wet cake was water-washed by the aforementioned basket type centrifugal separator until the electric conductivity of the filtrate was 5 μS/cm. The wet cake was then shifted to the Flash Jet Dryer (by Seishin Kigyo Co., Ltd.) and was dried until the amount of water was reduced to 0.5% parts by mass, whereby colored particles 1 were prepared. The colored particles 1 had a median diameter (D50) of 6.5 μm in the volume standard having a core/shell structure, and a glass transition temperature (Tg) of 39.5° C.

[Preparation of the Developer]

The metallic oxide and metallic soap of Table 1 were added to the toner matrix prepared by the polymerization method and were stirred by a Henschel mixer to get toner particles 1 through 7. The amounts of metallic oxide and metallic soap added are given in terms of percentage by mass with respect to toner matrix.

TABLE 1

| Toner sample name | Metallic oxide (% by mass) Large-diameter silica | Small-diameter silica | Titania | Metallic soap (% by mass) | |
|---|---|---|---|---|---|
| Toner 1 | 0.75 | 0.60 | 0.40 | Zinc stearate | 0.15 |
| Toner 2 | 0.70 | 0.65 | 0.40 | Zinc stearate | 0.25 |
| Toner 3 | 0.75 | 0.60 | 0.40 | Zinc stearate | 0.30 |
| Toner 4 | 0.60 | 0.50 | 0.50 | Zinc stearate | 0.15 |
| Toner 5 | 0.75 | 0.60 | 0.40 | Zinc stearate | 0.03 |
| Toner 6 | 0.75 | 0.60 | 0.40 | None | |
| Toner 7 | 0.75 | 0.60 | 0.40 | Zinc stearate | 0.10 |
| Toner 8 | 0.75 | 0.60 | 0.40 | Potassium stearate | 0.15 |

Large-diameter silica: NAX 50 (by Nippon Aerosil Co., Ltd.)
Small-diameter silica: R805 (by Nippon Aerosil Co., Ltd.)
Titania: STT30S (Titan Kogyo K. K.)

[Preparation of Photoreceptor]

(Preparation of Photoreceptor 1)

A photoreceptor 1 was prepared according to the following procedure:

A 30 mm-diameter cylindrical aluminum substrate (machined to the ten-point average surface roughness Rz=0.81 μm as stipulated in JIS B0601, by a cutting operation) was produced.

<Formation of the Intermediate Layer>

One part of binder resin (the aforementioned compound N-1) and 20 parts of ethanol/n-propyl alcohol/THF (45:20:35 in terms of volume ratio) were mixed, stirred and dissolved. After that, this mixture was mixed with 4.2 parts of titanium oxide (having a number-average particle size of 35 nm subsequent to the process of hydrophobing). Then this mixture was dispersed by a bead mill to prepare an intermediate layer coating solution. After having been filtered, this coating solution was coated on the aforementioned cylindrical aluminum substrate to form an intermediate layer having a dry film thickness of about 2 μm.

N-1

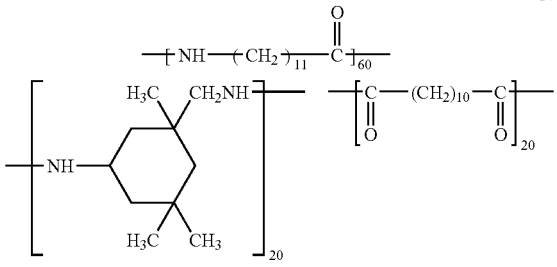

<Formation of the Electric Charge Generation Layer>

20 parts of titanyl phthalocyanine pigment (having a maximum diffraction peak at least at a position of Bragg angle 2θ=27.3° according to the Cu—Kα characteristic X-ray diffraction spectral analysis), 10 parts of polyvinyl butyral (BX-1 by Sekisui Chemical Co., Ltd.), 700 parts of methyl ethyl ketone, and 300 parts of cyclohexane were mixed, and were dispersed using a sand mill for ten minutes to prepare a electric charge layer coating solution. This coating solution was coated on the intermediate layer according to the dip coating method to produce an electric charge generation layer having a dry film thickness of 0.3 μm.

<Formation of the Electric Charge Transport Layer>

The following components were mixed and dissolved to produce an electric charge transport layer coating solution. This coating solution was coated on the electric charge generation layer according to the dip coating method, and was dried at 120° C. for 70 minutes, whereby an electric charge transport layer having a dry film thickness of 20 μm was produced.

Electric charge transport substance (substance B described below): 50 parts

Polycarbonate resin "Eupiron Z300" (by Mitsubishi Gas Chemical Co. Inc.): 100 parts Anti-oxidant 2,6-ditertiary butyl 4-methylphenol: 8 parts Tetrahydrofuran/toluene (volume ratio: 8/2): 750 parts Compound B

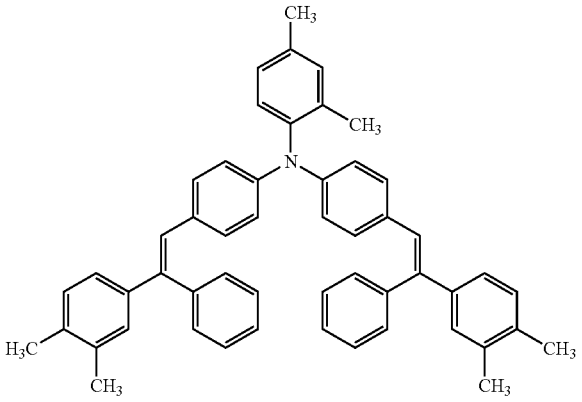

<Formation of the Protective Layer>

1.0 part of the following curable material (1) was dissolved in the mixture solution of 5.1 parts of 1-propanol and 2.4 parts of methyl isobutyl ketone. Further, 0.6 parts of fluorine resin particles (having an average particle size of 300 nm) and 0.6 parts of alumina particle 1 (having an number-average particle size of 50 nm, having been subjected to surface treatment by methyl hydrogen polysiloxane) was added to this solution and was dispersed by an ultrasonic homogenizer for 15 minutes to get a dispersion liquid containing a curable material, fluorine resin particles, and alumina particles. Then 0.05 parts of radical curing initiator (compound D) was added to this dispersion liquid to prepare a protective layer coating solution.

Curing material (1): A mixture having a mass ratio of 3/7 between the following (a) and (b)

(a) Illustrated compounds (30): Ditrimethylol propane tetraacrylate (tetrafunctional with a molecular weight of 466.5 and a trade name of Aronix M-408 by Toagosei Co., Ltd.)

(b) Illustrated compounds (39): (Bifunctional with a molecular weight of 450 and a trade name of Ebecryl E-4858 by Daicel Sitec)

The following describes the coating solution was coated on the photosensitive layer according to the circular slide hopper method. After coating, the layer was dried at room temperature for ten minutes, and a photosensitive drum was placed 100 mm away from a 2 kW high-pressure mercury lamp. While this drum was rotated, the layer was irradiated for three minutes so that the protective layer was cured by reaction. Subsequent to photo curing, the layer was heated and dried at 120° C. for 30 minutes, and an electrophotographic photoreceptor provided with a 2 μm protective layer was produced. This was named the photoreceptor 1.

Compound D

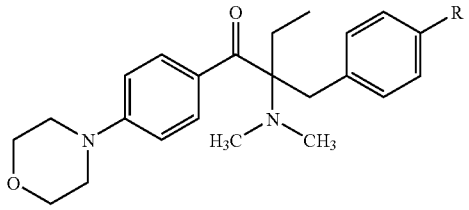

(Production of Photoreceptor 2)

The photoreceptor 2 was produced in the same procedure as that of producing the photoreceptor 1, except that the following (2) was used as a curable material, and 0.6 parts of alumina particles 1 and 0.8 parts of alumina particles 2 were employed.

Curable material (2): Illustrated compound (7) dipentaerithritol hexaacrylate (hexafunctional with a molecular weight of 547 and a trade name of KAYARAD DPHA by Nippon Kayaku Co.)

(Production of Photoreceptor 3)

The photoreceptor 3 was produced in the same procedure as that of producing the photoreceptor 1, except that 0.6 parts of alumina particles 1 and 0.4 parts of alumina particles 3 were employed.

(Production of Photoreceptor 4)

The photoreceptor 4 was produced in the same procedure as that of producing the photoreceptor 1, except that the following (3) was used as the curable material.

Curable material (3): Illustrated compound (31) Pentaerithritol tetraacrylate (tetrafunctional with a molecular weight of 352.3 and a trade name of Aronix M-450 by Toagosei Co., Ltd.)

(Production of Photoreceptor 5)

The photoreceptor 5 was produced in the same procedure as that of producing the photoreceptor 1, except that 0.8 parts of alumina particles 1 were employed.

(Production of Photoreceptor 6)

The photoreceptor 6 was produced in the same procedure as that of producing the photoreceptor 1, except that the following (4) was used as the curable material.

Curable material (4): Urethane acrylate (trifunctional with a molecular weight of 1500 and a trade name of Ebecryl 9260 by Daicel Sitec)

(Production of Photoreceptor 7)

The photoreceptor 7 was produced in the same procedure as that of producing the photoreceptor 1, except that the following (5) was used as the curable material.

Curable material (5): Urethane diacrylate (bifunctional with a molecular weight of 5000 and a trade name of Ebecryl 230 by Daicel Sitec)

(Production of Photoreceptor 1 for Comparison)

The laminated photoreceptor of the intermediate layer, electric charge generation layer, and electric charge transport layer using the same procedure as that in the process of producing the photoreceptor 1, up to the formation of the electric charge transport layer.

A protective layer coating solution was prepared by mixing and dissolving the following component. This solution was coated on the electric charge transport layer according to the circular slide hopper method. After coating, the layer was dried at 120° C. for 70 minutes to form a protective layer having a dry film thickness of 5 μm.

Electric charge transport substance (compound B): 20 parts

Polycarbonate resin "Eupiron Z300" (by Mitsubishi Gas Chemical Co. Inc.): 30 parts Anti-oxidant 2,6-ditertiary butyl 4-methylphenol: 8 parts Alumina particles 1: 6 parts Tetrahydrofuran/toluene (volume ratio: 8/2): 750 parts This photoreceptor was named the Comparative photoreceptor 1.

(Production of Photoreceptor 2 for Comparison)

A photoreceptor was produced using the same procedure as that in the process of producing the photoreceptor 1, except that the alumina particles 1 were not added. This photoreceptor was named the Comparative photoreceptor 2.

(Production of Photoreceptor 3 for Comparison)

A photoreceptor was produced using the same procedure as that in the process of producing the photoreceptor 1, except that zinc antimonate (CX-Z210IP having a particle size of 15 nm) were used instead of alumina particles 1. This photoreceptor was named the Comparative photoreceptor 3.

(Production of Photoreceptor 4 for Comparison)

A photoreceptor was produced using the same procedure as that in the process of producing the photoreceptor 1, except that antimony-doped tin particles (T-1 by Mitsubishi Material Co. Inc.) were used instead of alumina particles 1. This photoreceptor was named the Comparative photoreceptor 4.

Table 2 shows the compositions of a photoreceptor sample. The amounts of metallic oxides to be added are given in terms of percentage by mass with respect to polycarbonate resin for the comparative photoreceptor 1, and in terms of percentage by mass with respect to the curable compound for others.

TABLE 2

| | Curable material | | | | |
|---|---|---|---|---|---|
| Photoreceptor sample name | Curable material type | Number of reactive groups | Reactive group equivalent | Alumina particles (% by mass) | |
| Photoreceptor 1 | Curable material (1) | 4, 2 | 116.6, 225 | Alumina particles 1 | 60 |
| Photoreceptor 2 | Curable material (2) | 6 | 91.2 | Alumina particles 2 | 80 |
| Photoreceptor 3 | Curable material (1) | 4, 2 | 116.6, 225 | Alumina particles 3 | 40 |
| Photoreceptor 4 | Curable material (3) | 4 | 88.1 | Alumina particles 1 | 60 |
| Photoreceptor 5 | Curable material (1) | 4, 2 | 116.6, 225 | Alumina particles 1 | 80 |
| Photoreceptor 6 | Curable material (4) | 3 | 500 | Alumina particles 1 | 60 |
| Photoreceptor 7 | Curable material (5) | 2 | 2500 | Alumina particles 1 | 60 |
| Comparative photoreceptor 1 | Polycarbonate (non-curable compound) | | | Alumina particles 1 | 20 |
| Comparative photoreceptor 2 | Curable material (1) | 4, 2 | 116.6, 225 | None | |
| Comparative photoreceptor 3 | Curable material (1) | 4, 2 | 116.6, 225 | Zinc antimonite | 60 |
| Comparative photoreceptor 4 | Curable material (1) | 4, 2 | 116.6, 225 | Tin oxide | 60 |

In Table 2, alumina particles 1 refer to the alumina particles having been subjected to surface treatment by methyl hydrogen polysiloxane, with a number-average particle size of 50 nm, alumina particles 2 indicate the alumina particles having been subjected to surface treatment by hexamethyl disilazane, with a number-average particle size of 10 nm, and alumina particles 3 represent the alumina particles having been subjected to surface treatment by trimethyl methoxy siloxane, with a number-average particle size of 100 nm.

[Performance Evaluation]

Toner and photoreceptors of bizhub C-351 by Konica Minolta Business Technology Co., Ltd. were replaced by Toners 1 through 8, photoreceptors 1 through 7, and comparative photoreceptors 1 through 4 as shown in Table 3, and copying operation was performed using 5,000 sheets on a continuous basis in an environment of normal temperature and humidity (20° C. and 50% RH). After that, the following items were evaluated.

Evaluation items were "dropout", "comet-like defect", and "photoreceptor damage". Evaluation was made according to the following criteria.

A: No defect at all

B: Some defects found without any problems in practical use

C: Some defects found, but can be used somehow

D: With practical problem

TABLE 3

| | | | Evaluation result | | |
|---|---|---|---|---|---|
| Test No. | Toner sample | Photoreceptor sample | Dropout | Comet-like defect | Photo-receptor damage |
| Example 1 | Toner 1 | Photoreceptor 1 | A | B | B |
| Example 2 | Toner 2 | Photoreceptor 2 | A | B | B |
| Example 3 | Toner 3 | Photoreceptor 3 | B | B | B |
| Example 4 | Toner 4 | Photoreceptor 4 | B | B | B |
| Example 5 | Toner 5 | Photoreceptor 5 | A | B | B |
| Example 6 | Toner 1 | Photoreceptor 6 | B | B | B |
| Example 7 | Toner 7 | Photoreceptor 7 | B | B | C |
| Example 8 | Toner 8 | Photoreceptor 1 | B | B | B |
| Comparative example 1 | Toner 1 | Comparative photoreceptor 1 | D | B | D |
| Comparative example 2 | Toner 1 | Comparative photoreceptor 2 | B | D | C |
| Comparative example 3 | Toner 1 | Comparative photoreceptor 3 | C | D | B |
| Comparative example 4 | Toner 1 | Comparative photoreceptor 4 | D | D | C |
| Comparative example 5 | Toner 6 | Photoreceptor 1 | D | D | B |

As is apparent from the results illustrated in Table 3, excellent characteristics have been demonstrated in the examples of the present invention. In the comparative examples outside the scope of the present invention, problems are found in any of the characteristics.

What is claimed is:

1. A method for forming an image comprising steps of:

(a) developing an electrostatic latent image by a toner on an electrophotographic photoreceptor comprising a conductive support provided thereon, at least a photoreceptive layer and a protective layer in this order; and (b) transferring the developed toner to an intermediate transfer member, wherein the toner comprises at least a metal oxide and a metal soap by external addition, and the protective layer comprises at least a resin component by the reaction of a curable acrylic compound, and alumina particles.

2. The method for forming an image of claim 1, wherein a number of a reactive group in the curable compound is 3 or more.

3. The method for forming an image of claim 1, wherein the number of a reactive group in the curable compound is 5 or more.

4. The method for forming an image of claim 1, wherein an equivalent of a reactive group in the curable compound is 1,000 or less.

5. The method for forming an image of claim 1, wherein an equivalent of a reactive group in the curable compound is 500 or less.

6. The method for forming an image of claim 1, wherein a reactive group in the curable compound is acryloyl group or methacryloyl group.

7. The method for forming an image of claim 1, wherein a surface of the alumina particles is hydrophobized by a silane compound.

8. The method for forming an image of claim 1, wherein the alumina particles is 1-200 parts by mass with respect to 100 parts by mass of the curable compound.

9. The method for forming an image of claim 1, wherein the alumina particles is 10-80 mass parts with respect to 100 mass parts of the curable compound.

10. The method for forming an image of claim 1, wherein a number average primary particle diameter of the alumina particles is 1-300 nm.

11. The method for forming an image of claim 1, wherein a number average primary particle diameter of the alumina particles is 3-100 nm.

12. An image forming apparatus, wherein an image is formed by the method for forming an image of claim 1.

* * * * *